US006206167B1

(12) United States Patent
Taylor et al.

(10) Patent No.: US 6,206,167 B1
(45) Date of Patent: Mar. 27, 2001

(54) COIN TURNING COIN-ENTRANCE CHUTE

(75) Inventors: Darrell Taylor, Duluth; Manfred Waldecker, Lawrenceville, both of GA (US)

(73) Assignee: Elcotel, Inc., Sarasota, FL (US)

( * ) Notice: Subject to any disclaimer, the term of this patent is extended or adjusted under 35 U.S.C. 154(b) by 0 days.

(21) Appl. No.: 09/405,773

(22) Filed: Sep. 27, 1999

(51) Int. Cl.[7] ..... G07F 1/04
(52) U.S. Cl. ..... 194/344; 193/DIG. 1
(58) Field of Search ..... 194/344, 347, 194/348, 349; 193/DIG. 1

(56) References Cited

U.S. PATENT DOCUMENTS 4,821,863 * 4/1989 Okada ..... 194/344
5,370,211 * 12/1994 Plana ..... 194/344
5,425,439 * 6/1995 Tsuchida ..... 194/344

FOREIGN PATENT DOCUMENTS 2-183890 * 7/1990 (JP) ..... 194/344

* cited by examiner

*Primary Examiner*—Robert P. Olszewski
*Assistant Examiner*—Bryan Jaketic
(74) *Attorney, Agent, or Firm*—Schnader Harrison Segal & Lewis, LLP

(57) ABSTRACT

A coin turning entrance chute for coin-operated devices descends from an upper coin-entry slot to a lower exit slot floor and curved sidewalls. The sidewalls have different radii of curvature to define a wider coin path at the curvature to allow the coin to turn. An exit slot is provided. The entrance chute rotates the coin from an initial edge-forward orientation to a face-forward orientation when passing through the exit slot.

20 Claims, 2 Drawing Sheets

COIN TURNING COIN-ENTRANCE CHUTE

FIELD OF THE INVENTION

The invention relates generally to a coin-entrance chute for coin-operated devices. More specifically, the invention relates to a coin turning entrance chute whereby a coin is turned within the device from an edge forward position to a face forward position. Most specifically, the invention is a coin turning entrance chute for use in pay telephones.

DESCRIPTION OF THE RELATED ART

As technology advances, telephones are getting smaller and smarter. Payphones are no exception. Within the telephone housing are complicated coin mechanisms, relays and even integrated circuit boards.

Changes in the layout of the internal mechanisms of standard pay telephones are required to accommodate the ever expanding need for integrated circuit boards among other items. Typically, a coin mechanism in a pay phone is mounted perpendicular to the face of the telephone. This arrangement is necessitated by the standard vertical orientation of the coin-entry slot. Valuable space would be freed, if the coin mechanism could be turned so that it is parallel to the face of the telephone. The extra space could then be used to accommodate additional boards for added phone features and performance.

Additionally, many pay telephones in use today do not accommodate larger coins such as a Susan B. Anthony dollar. This dollar coin is 26.5 mm in diameter, and is not accepted by most operating pay phones.

It is therefore desirous to create a coin-entrance chute which will turn a coin, even a large-diameter coin, from the standard edge facing vertical alignment to a face forward vertical alignment. Such a face forward arrangement will allow the coin mechanism to be turned parallel to the face of the phone thereby making more efficient use of the internal space within a set size phone housing.

SUMMARY OF THE INVENTION

A coin turning entrance chute is disclosed. The entrance chute descends from the upper coin-entry slot to a lower exit slot which leads to the coin mechanism. The chute includes a curved floor member having a coin drop slot at its lower end. Two curved sidewalls are provided for guiding the coin along its path. The two walls have varying radii of curvature, so as to define a space within the coin chute for allowing the coin to extend past a tangential point of contact with one of the walls. The entrance chute turns the coin from an edge forward alignment to a face forward alignment.

DETAILED DESCRIPTION OF THE INVENTION

Figure 1:
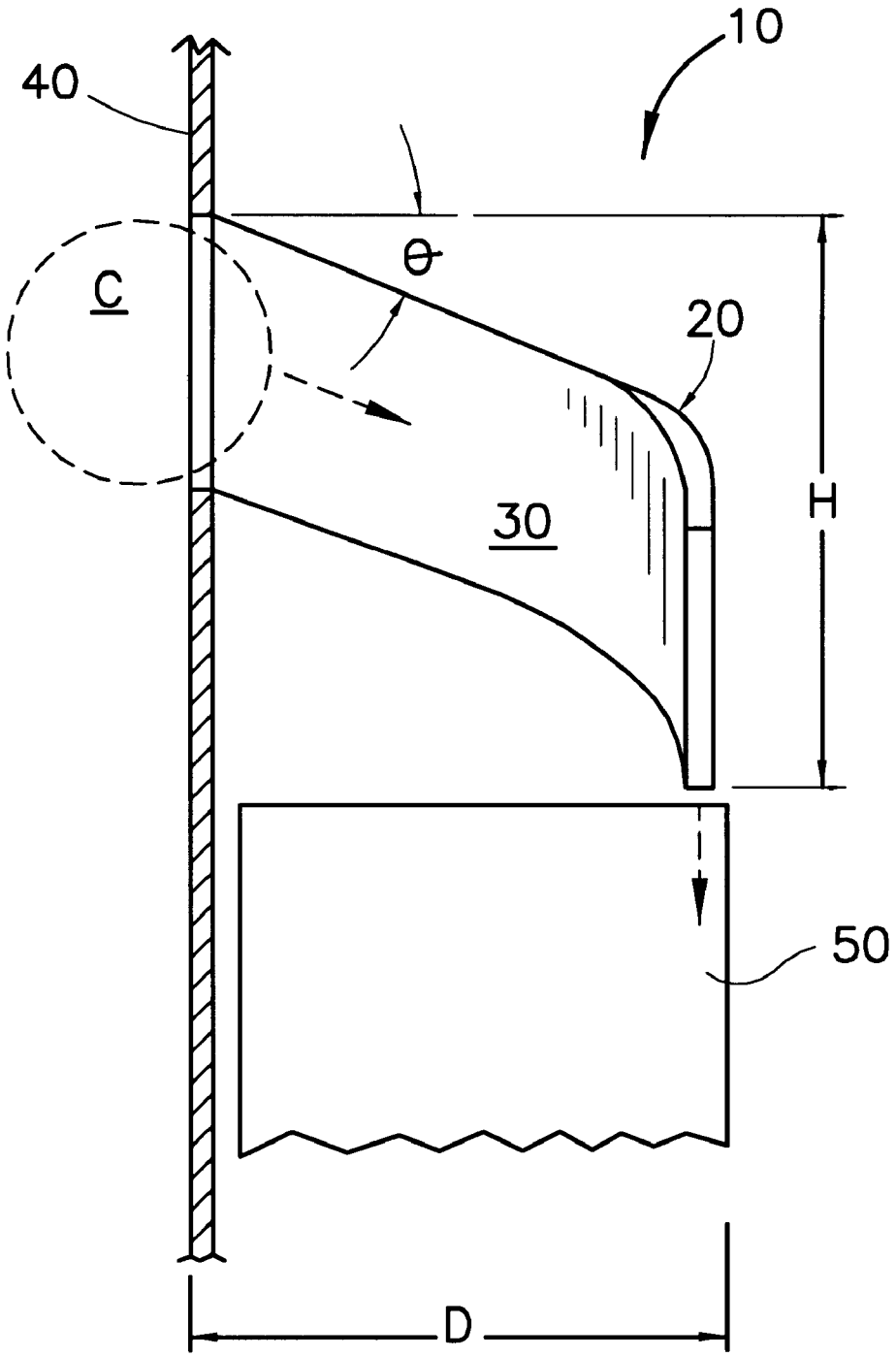
FIG. 1 is a partial cross-sectional, side view of a coin-turning entrance chute of the invention.

A coin turning entrance chute 10 for a coin-operated device, especially a pay telephone, is shown in the Figures wherein like numerals represent like elements throughout.

A typical pay telephone is generally rectangular in shape with long sides in the vertical orientation. The face plate of the phone is provided with a coin deposit slot, a hand set cradle and hand set, buttons for dialing, and typically a coin return. The invention is directed toward a coin-entrance chute 10 which leads from the coin deposit slot 12 to a coin mechanism 50 which handles the coins during the life of the call.

The entrance chute 10 is a narrow passageway defined by a floor 14 and two sidewalls 20, 30. The sidewalls 20, 30 are spaced appropriately for maintaining the coin C in its substantially vertical, on-edge orientation. The entrance chute 10 according to the invention descends at an angle θ from the deposit slot 12 to the coin mechanism 50. This angle is preferably about 17° from the horizontal. The angled nature of the entrance chute 10 allows the coin C to roll under the influence of gravity. At the lower end of the chute, a coin exit slot 16 in the floor 14 is provided, for allowing a coin C to pass therethrough and into the coin mechanism 50 below.

The two sidewalls 20,30 define a coin path. The coin path is of sufficient width to allow a coin to freely pass through, but not so wide as to let the coin fall from an on-edge position. From the coin deposit slot, the sidewalls extend perpendicularly from the face plate 40. Each sidewall then curves as the chute descends, until a 90° turn has been completed, after which the chute 10 extends substantially parallel to the face plate 40 of the telephone.

The curved portions of the two sidewalls 20, 30 have different radii of curvature $R_1$, $R_2$. The difference creates a wider coin path to accommodate a coin as it turns. The widened coin path is not so wide as to allow a coin to topple from its on-edge position. Rather, the widened path allows, and directs turning of the coin as it travels down the coin chute, while maintaining the on-edge orientation. The first, or outer, sidewall 20 has longer straight portions and a tighter curving radius $R_1$. The second, or inner, sidewall 30 has shorter straight portions and a larger curving radius $R_2$. Preferably, the largest coin C used will be a 26.5 mm coin. Accordingly, the dimensions of the coin chute 10 must be sufficient to allow turning of a 26.5 mm coin.

Figure 2:
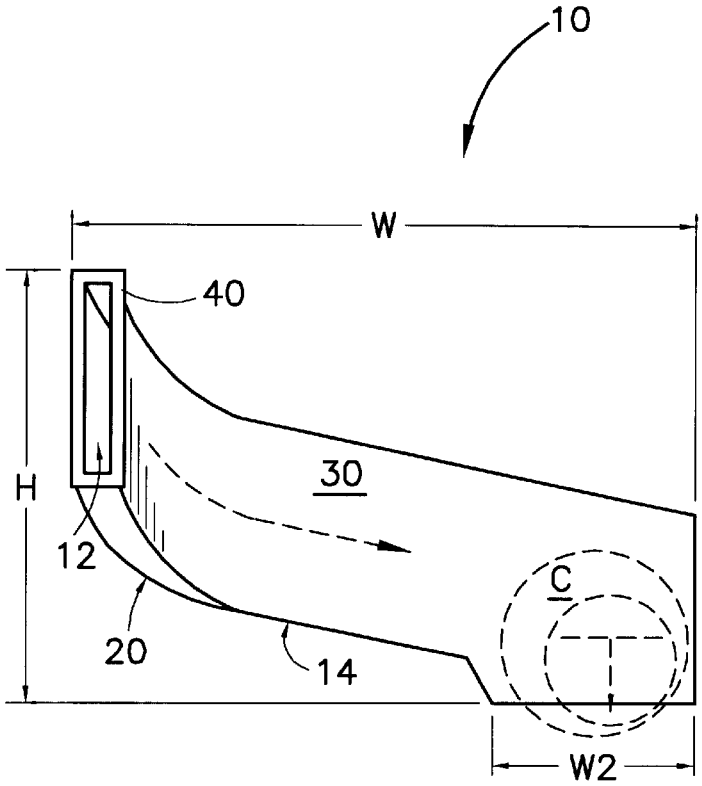
FIG. 2 is a front elevational view of a coin-turning entrance chute of the invention.
Figure 3:
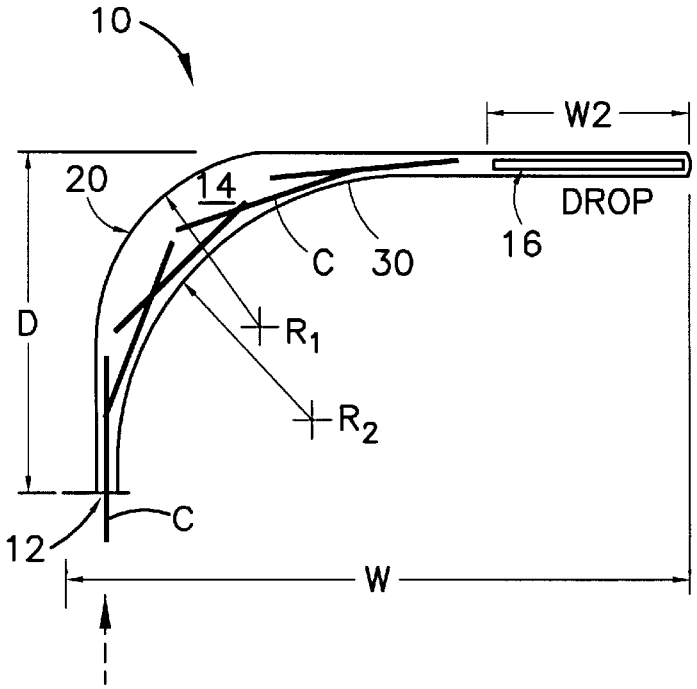
FIG. 3 is a plan view of a coin-turning entrance chute of the invention, showing the path of a coin passing therethrough.

In the preferred embodiment, the coin path defined by the straight portions of the sidewalls 20, 30 is about 0.125 inches wide. The radius $R_1$ of curvature for the outer sidewall 20 is preferably about 0.812 inches while the radius of curvature $R_2$ for the second, inner wall 30, is about 1.400 inches. As shown in FIG. 2, the lower end of the coin chute preferably extends vertically downward to aid in directing the exiting coin into the coin mechanism. The extension has a preferable width W2 of about 1.5 inches.

In operation, a coin C is inserted into the coin-entry slot 12 and travels straight forward for a short distance before beginning to curve. While traveling downward, one face of the coin is oriented parallel to the tangent of the curvature of the second, inner sidewall 30. The coin C may actually make contact with the second sidewall 30, although this is not necessary. The edges of the coin extend past the tangential point and into the space created by the different curvatures of the walls 20, 30. As the coin C rolls downward along the chute floor 14, it is turned gently 90° until one of its faces is substantially parallel to the face plate 40. The coin C then travels for a short distance on a straight path before falling through the coin exit slot 16 provided in the floor 14. The coin C then enters the coin mechanism 50 which can be mounted parallel to the face plate 40 because the coin has been turned.

With the preferred maximum coin size of 26.5 mm, turning the coin about 90° can occur in a space as small as about 1.82 inches deep D by about 3.06 inches wide W by about 3.10 inches in height H. These preferred dimensions allow the coin chute to occupy substantially the same planar foot print as the coin mechanism. This design allows for the installation of a coin mechanism parallel to the face of the telephone rather than the traditional perpendicular mount. The parallel orientation frees internal space within the telephone for additional integrated circuit boards or other components needed in today's phones.

The above description relates to the coin-entrance chute for a pay telephone and is specifically designed for a maximum coin size of 26.5 mm, but could be adapted for other applications and other sized coins as is readily apparent to those skilled in the art.

What is claimed is:

1. A coin-entrance chute for a coin-operated device comprising:

(a) a floor, defining a coin-exit at one end;

(b) a first, outer, sidewall extending from said floor;

(c) a second sidewall, inner, extending from said floor, and displaced from said first sidewall to define a coin path therebetween and a forward-facing coin-entrance at an end opposite said coin-exit; and (d) wherein said first and said second sidewalls each curve about 90° such that a coin traveling through said coin path will turn about 90° from an edge-forward orientation to a face-forward orientation before dropping through said exit slot.

2. The chute of claim 1, wherein said chute is angled downward with said coin-entrance at its upper end.

3. The chute of claim 2, wherein said chute is angled downward, about 17° from the horizontal.

4. The chute of claim 1, wherein said chute is for use in a pay telephone.

5. The chute of claim 1, wherein said exit slot extends vertically downward from said floor to guide the coin to a vertical drop into the coin mechanism.

6. The chute of claim 5, where said chute is for use in a pay telephone.

7. A coin-entrance chute for a coin-operated device comprising:

(a) a floor, defining a coin-exit at one end;

(b) a first outer, sidewall extending from said floor;

(c) a second sidewall, inner, extending from said floor, and displaced from said first sidewall to define a coin path therebetween and a forward-facing coin-entrance at an end opposite said coin-exit; and (d) wherein said first and said second sidewalls each curve about 90° such that a coin traveling through said coin path will turn about 90° from an edge-forward orientation to a face-forward orientation before dropping through said exit slot; and (e) wherein each of said first and second sidewalls has a different radius of curvature whereby a wider path is defined at the curve by said sidewalls to allow for coin-turning.

8. The chute of claim 7, wherein said radius of curvature for said first sidewall is less than that of said second sidewall.

9. A coin-entrance chute for a coin-operated device comprising:

(a) a floor, descending at a predetermined angle, and defining a coin-exit at its lower end;

(b) a first, outer, curved sidewall extending upward from said floor;

(c) a second, inner, curved sidewall extending upward from said floor, and displaced from said first sidewall to define a coin path therebetween, and a forward-facing coin-entrance at an end opposite said coin-exit slot;

(d) wherein said sidewalls curve about 90° such that a coin traveling therebetween is turned from an edge-forward orientation to a face-forward orientation before dropping through said exit.

10. The chute of claim 9, wherein said chute descends at a predetermined angle of about 17° below horizontal.

11. The chute of claim 9, wherein said exit comprises a slot extending vertically downward from said floor to guide the coin to a vertical drop into a coin mechanism.

12. The chute of claim 11, wherein said chute is for use in a pay telephone.

13. A coin-entrance chute for a coin-operated device comprising:

(a) a floor, descending at a predetermined angle, and defining a coin-exit at its lower end;

(b) a first, outer, curved sidewall extending upward from said floor, (c) a second, inner, curved sidewall extending upward from said floor, and displaced from said first sidewall to define a coin path therebetween, and a forward-facing coin-entrance at an end opposite said coin-exit slot;

(d) wherein said sidewalls curve about 90° such that a coin traveling therebetween is turned from an edge-forward orientation to a face-forward orientation before dropping through said exit; and wherein each of said first and second sidewalls has a different radius of curvature whereby a wider path is defined at the curve by said sidewalls to allow for coin-turning.

14. The chute of claim 13, wherein said radius of curvature for said first sidewall is less than that of said second sidewall.

15. The chute of claim 14, wherein said chute is for use in a pay telephone.

16. A coin-entrance chute assembly for use in a coin-operated pay telephone comprising:

(a) a face plate defining a substantially vertical coin-entrance;

(b) a coin chute in communication with said entrance said chute comprising:

a floor, descending at a predetermined angle, and defining a coin-exit at its lower end;

a first, outer, curved sidewall extending upward from said floor;

a second, inner, curved sidewall extending upward from said floor, and displaced from said first sidewall to define a coin path therebetween, and a forward-facing coin-entry at an end opposite said coin-exit slot;

wherein said sidewalls curve about 90° such that a coin traveling therebetween is turned from an edge-forward orientation to a face-forward orientation before dropping through said exit; and (c) a coin mechanism, mounted within the pay phone, substantially parallel to said face plate, for receiving coins as they drop through said coin-exit.

17. The chute assembly of claim 16, wherein said chute is angled downward, about 17° from the horizontal.

18. The chute assembly of claim 16, wherein said coin-exit extends vertically downward from said floor to guide the coin to a vertical drop into said coin mechanism.

19. A coin-entrance chute assembly for use in a coin-operated pay telephone comprising:

(a) a face plate defining a substantially vertical coin-entrance;

(b) a coin chute in communication with said entrance said chute comprising:

a floor, descending at a predetermined angle, and defining a coin-exit at its lower end;

a first, outer, curved sidewall extending upward from said floor;

a second, inner, curved sidewall extending upward from said floor, and displaced from said first sidewall to define a coin path therebetween, and a forward-facing coin-entry at an end opposite said coin-exit slot;

wherein said sidewalls curve about 90° such that such a coin traveling therebetween is turned from an edge-forward orientation to a face-forward orientation before dropping through said exit; and (c) a coin mechanism, mounted within the pay phone, substantially parallel to said face plate, for receiving coins as they drop through said coin-exit;

wherein each of said first and second sidewalls has a different radius of curvature whereby a wider path is defined at the curve by said sidewalls to allow for coin-turning.

20. The chute assembly of claim 19, wherein said radius of curvature for said first sidewall is less than that of said second sidewall.

* * * * *